US005454199A

United States Patent [19]

Blom et al.

[11] Patent Number: 5,454,199

[45] Date of Patent: Oct. 3, 1995

[54] WALL CLIP FOR CONCRETE FORMING SYSTEM

[75] Inventors: Kenneth M. Blom, Kansas City, Mo.; Jay D. Williamson, Papillion; Jamieson Vaughan, Omaha, both of Nebr.

[73] Assignee: I.S.M., Inc., Paola, Kans.

[21] Appl. No.: 269,549

[22] Filed: Jul. 1, 1994

[51] Int. Cl.[6] ..... E04C 1/00; E04B 2/00

[52] U.S. Cl. ..... 52/422; 52/565; 52/309.2; 52/309.17

[58] Field of Search ..... 52/309.2, 309.9–309.12, 52/309.17, 699, 712, 714, 715, 364, 367, 371, 379, 422, 425, 426, 440, 441, 432, 437, 564, 565

[56] References Cited

U.S. PATENT DOCUMENTS

| | | | |
|---|---|---|---|
| 836,589 | 11/1906 | Layfield . | |
| 880,820 | 3/1908 | Pierson . | |
| 1,871,318 | 8/1932 | Greenwood . | |
| 3,778,020 | 12/1973 | Burrows et al. . | |
| 3,782,049 | 1/1974 | Sachs . | |
| 3,788,020 | 1/1974 | Gregori . | |
| 3,872,636 | 3/1975 | Nicosia . | |
| 3,922,828 | 12/1975 | Patton . | |
| 3,979,867 | 9/1976 | Sowinski . | |
| 4,223,501 | 9/1980 | DeLozier . | |
| 4,516,372 | 5/1985 | Grutsch . | |
| 4,669,234 | 6/1987 | Wilnau | 52/426 X |
| 4,698,947 | 10/1987 | McKay . | |
| 4,706,429 | 11/1987 | Young . | |
| 4,730,422 | 3/1988 | Young . | |
| 4,731,968 | 3/1988 | Obino . | |
| 4,750,308 | 6/1988 | McKay . | |
| 4,765,109 | 8/1988 | Boeshart . | |
| 4,860,515 | 8/1989 | Browning, Jr. | 52/422 X |
| 4,879,855 | 11/1989 | Berrenberg . | |
| 4,889,310 | 12/1989 | Boeshart . | |
| 4,967,528 | 6/1990 | Doran | 52/309.12 |
| 5,065,561 | 11/1991 | Mason . | |

FOREIGN PATENT DOCUMENTS

| | | | |
|---|---|---|---|
| 0196672 | 10/1986 | European Pat. Off. | 52/309.12 |

*Primary Examiner*—Michael Safavi
*Assistant Examiner*—Robert J. Canfield
*Attorney, Agent, or Firm*—Chase & Yakimo

[57] ABSTRACT

A wall clip for use with a concrete form comprises a vertical nailing surface or stud for receiving fasteners of finishing material therethrough. Linkage structures extend upper and lower anchors from the upper and lower ends of the stud and into the cavity between the form sidewalls. The anchors maintain the stud along the sidewalls during concrete pouring, curing and subsequent material fastening. The anchors further reinforce the concrete laden form.

10 Claims, 6 Drawing Sheets

WALL CLIP FOR CONCRETE FORMING SYSTEM

BACKGROUND OF THE INVENTION

This invention relates to concrete forming systems and, more particularly, to a releasable nailing surface which aids in the support of finished materials on the sidewalls of a concrete form.

The use of foam concrete forms in the construction industry is known. These forms present a pair of sidewalls with vertical and/or horizontal cavities formed therebetween. Upon filling the cavities with concrete a concrete wall is presented between the insulating sidewalls. The forms have complementary mating elements for joining the forms in a side-by-side and/or over/under relationship. Examples of such concrete forms are shown in various patents including U.S. Pat. No. 3,788,020 to Gregori.

Upon use of the forms it is desirable to attach a finishing material, e.g. Sheetrock®, to the form sidewalls. One method has been to glue the Sheetrock® to the sidewall surface Also, DeLozier, U.S. Pat. No. 4,223,501, and Berrenberg, U.S. Pat. No. 4,879,855, disclose the uses of integrated members which present at their lateral ends nailing surfaces adjacent the exterior surfaces of the concrete form sidewalls.

Although assumably effective in their operation, such devices present increased installation and/or manufacturing costs, particularly as to those forms having the nailing surfaces integrated therein. Moreover, forms with integrated nailing surfaces may not be needed if no finish materials are desired, cannot present nailing surfaces at user-selectable points along the form.

In response thereto we have invented a wall clip for use with variously configured forms. The clip generally comprises a metal nailing surface or stud which is positioned adjacent the sidewall surfaces of the form. Upper and lower linkage members conform to the upper and lower edges of the form so as to maintain the stud in its desired position. The linkage members further extend anchors into the cavity between the sidewalls which are embedded in the poured concrete. The anchors hold the nailing stud in place while reinforcing the sidewalls. The linkage members and anchors are made of a pliable material so as to conform to the configuration of the tongues and grooves found along the upper and lower edges of the concrete forms. This characteristic precludes interference of the wall clip with the tongue/groove connection between adjacent forms.

It is therefore a general object of this invention to provide a wall clip for a concrete forming system which presents a nailing surface for attachment of finished materials to the concrete form.

Another object of this invention is to provide a wall clip, as aforesaid, which presents reinforcing anchors for embedment in the poured concrete.

A still further object of this invention is to provide a wall clip with anchors, as aforesaid, which maintains the nailing surface adjacent a form sidewall.

A more particular object of this invention is to provide a wall clip with anchors, as aforesaid, which effectively interface with the poured concrete.

A still further particular object of this invention is to provide a wall clip, as aforesaid, which does not interfere with the flow of concrete between the form sidewalls.

Still another object of this invention is to provide a wall clip, as aforesaid, which is easily installed at the job site without interfering with the mating of adjacent forms.

Another object of this invention is to provide a wall clip, as aforesaid, which is adaptable for use with variously configured concrete forms.

Other objects and advantages of this invention will become apparent from the following description taken in connection with the accompanying drawings, wherein is set forth by way of illustration and example, an embodiment of this invention.

Description of the Preferred Embodiment

Figure 1:
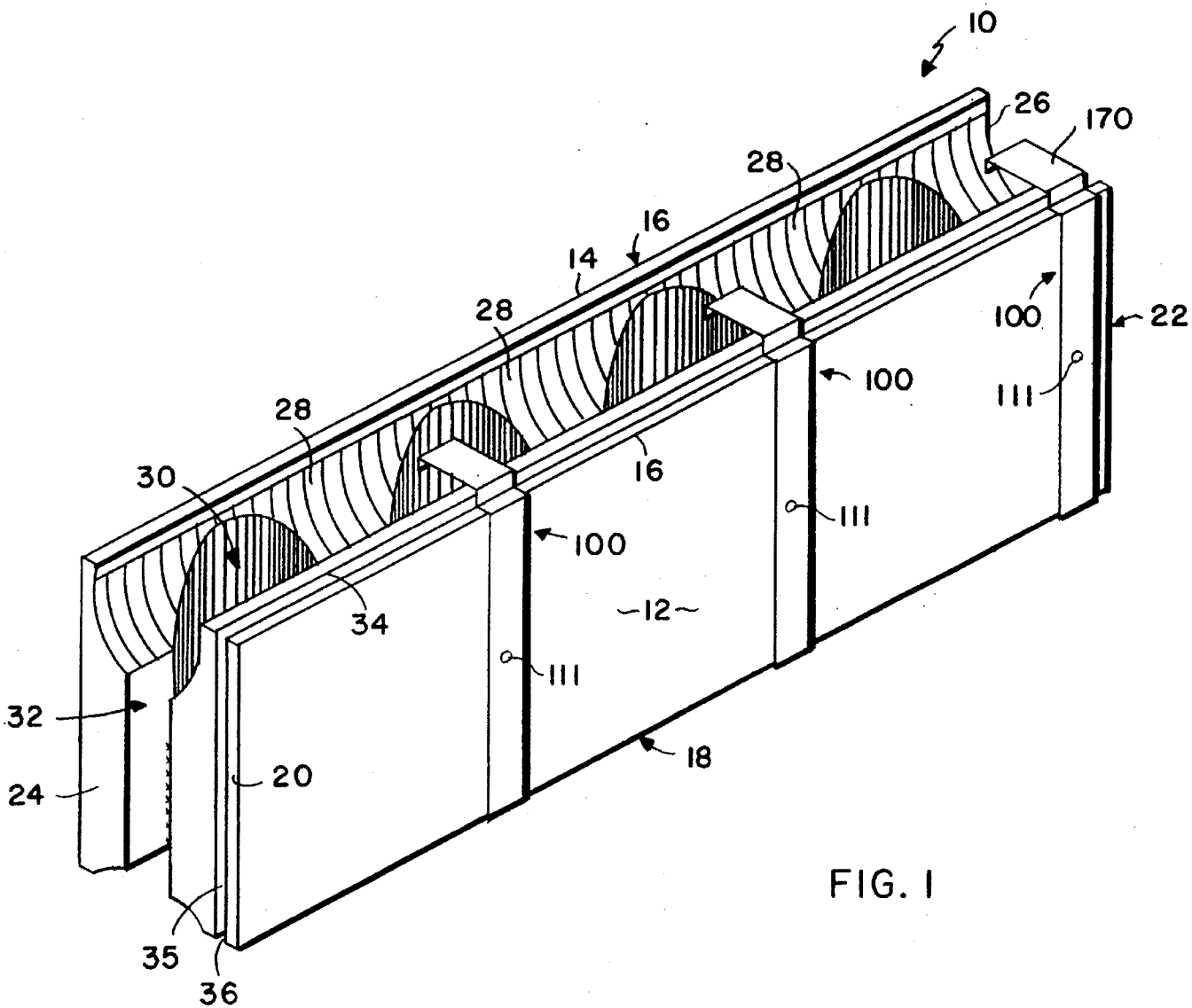
FIG. 1 is a perspective view of a concrete form with the wall clips in place.
Figure 2:
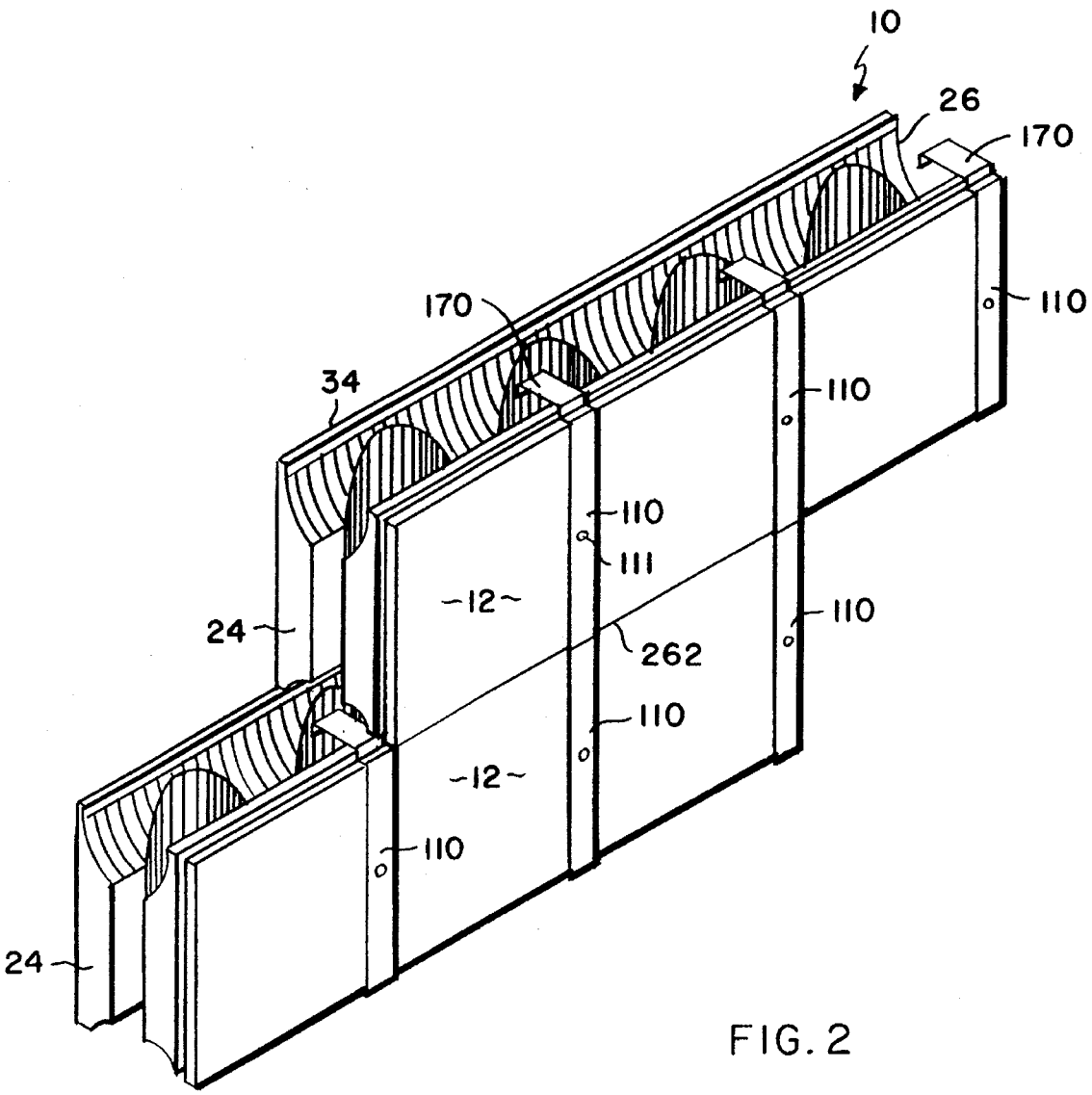
FIG. 2 is a perspective view showing the forms of FIG. 1 in an over/under relationship.
Figure 5:
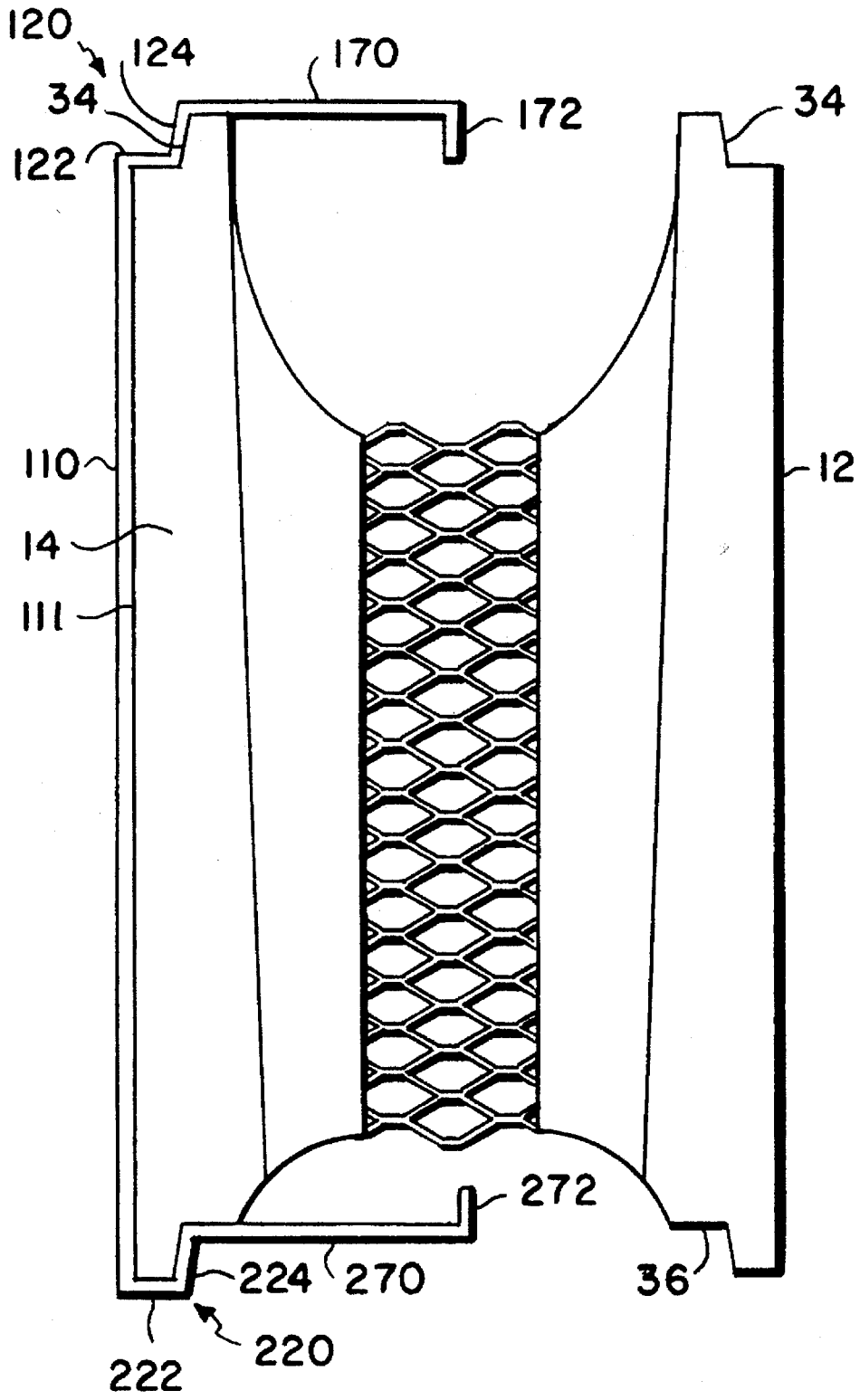
FIG. 5 is an end view of one type of concrete form using a lap-type of tongue and groove mating elements.

Turning more particularly to the drawings, FIG. 1 shows one type of concrete form 10 with the wall clips 100 installed thereon. Form 10 generally comprises a pair of laterally displaced sidewalls 12, 14. Each sidewall has upper 16 and lower 18 longitudinal edges as well as a pair of opposed vertical edges 20, 22. The form 10 further includes a pair of longitudinally displaced end walls 24, 26 with intermediate longitudinally spaced-apart partition walls 28. The sidewalls 12, 14, end walls 24, 26 and partition walls 28 cooperate to form a plurality of vertical cavities 30 and a vertical slot 32 between the facing surfaces of the end walls 24, 26 and partition walls 28. Slot 32 longitudinally spans the length of the form 10 and connects the cavities 30. Each form 10 has complementary tongues 34 extending along the respective upper 16 edges. These tongues 34 mate with complementary grooves 36 located along the lower edges of an overlying form 10. As shown in FIG. 5 the tongues and grooves form complementary lap joint surfaces which overlap to form a lap joint when one form is connected atop the other as shown in FIG. 2.

At one end the end walls 24 extend beyond the sidewalls. At the opposed end the sidewalls 12, 14 extend beyond the end wall 26. Thus, vertically extending lap joint surfaces are also formed. The end wall extensions 35 at one end of one form overlap with the sidewall extensions when forms are joined in a longitudinally adjacent relationship. Accordingly, the forms 10 may be connected in longitudinally extending courses and stacked one atop the other with reinforcing bars 600 therein.

Figure 6:
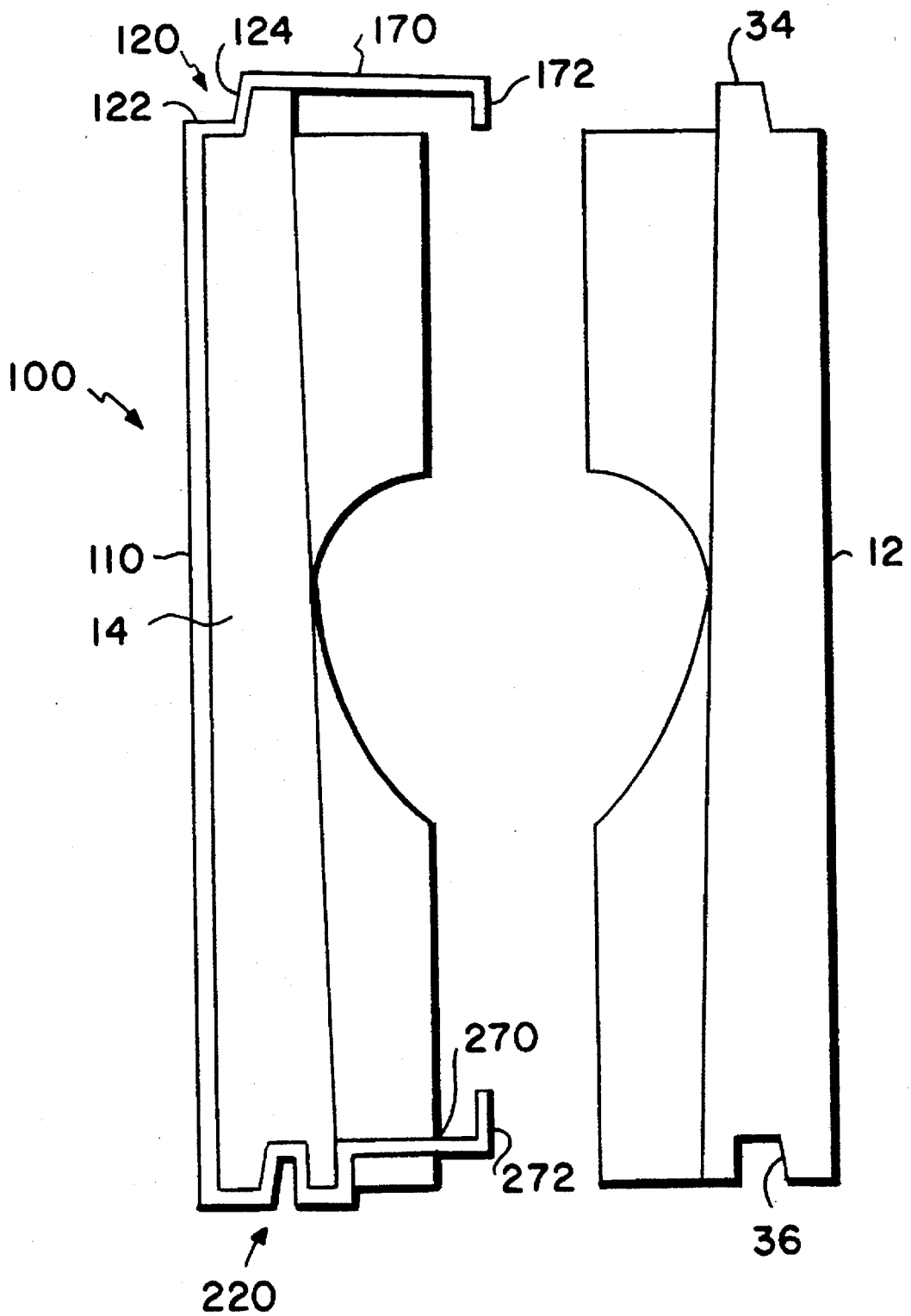
FIG. 6 is an end view of a second type of concrete form using conventional tongue/groove mating elements.

It is also understood that other types of tongue/groove mating elements may be used extending along the top and bottom edges of the form 10 such as those longitudinal tongues 34' and grooves 36' shown along the upper and lower edges of form sidewalls 12', 14' of FIG. 6.

In use the forms 10 are positioned atop a footing 500. It is understood that various types of connections of the first row of forms into the footing may be utilized such as by cementing 800 the forms 10 to the footing 500 or by placing the forms 10 in a wet footing and allowing the footing to subsequently dry. As shown in FIG. 2 the vertically stacked forms 10 are longitudinally staggered between rows so as to preclude the formation of a continuous vertical joint among the form rows. The poured concrete fills the vertical cavities 30 and longitudinally extending vertical slot 32 of each form. Also, upon stacking a second course of forms atop the first a horizontal channel 260 which spans the horizontal joint 262 is formed. The poured concrete will fill the channel 260 of the form. Thus, a concrete wall within slot 32, concrete piers within cavities 30 and a horizontal beam of concrete within channel 260 is presented. The forms 10 are left in place for insulating the resulting concrete wall.

It is known that the courses of the forms may be selectably configured so as to present walls of various configurations. Also, door frames, window frames, bucks, bulkheads, and the like may interrupt the courses of forms so as to provide openings for insertion of doors, windows and the like therein while precluding spillage of poured concrete from the forms.

Figure 3:
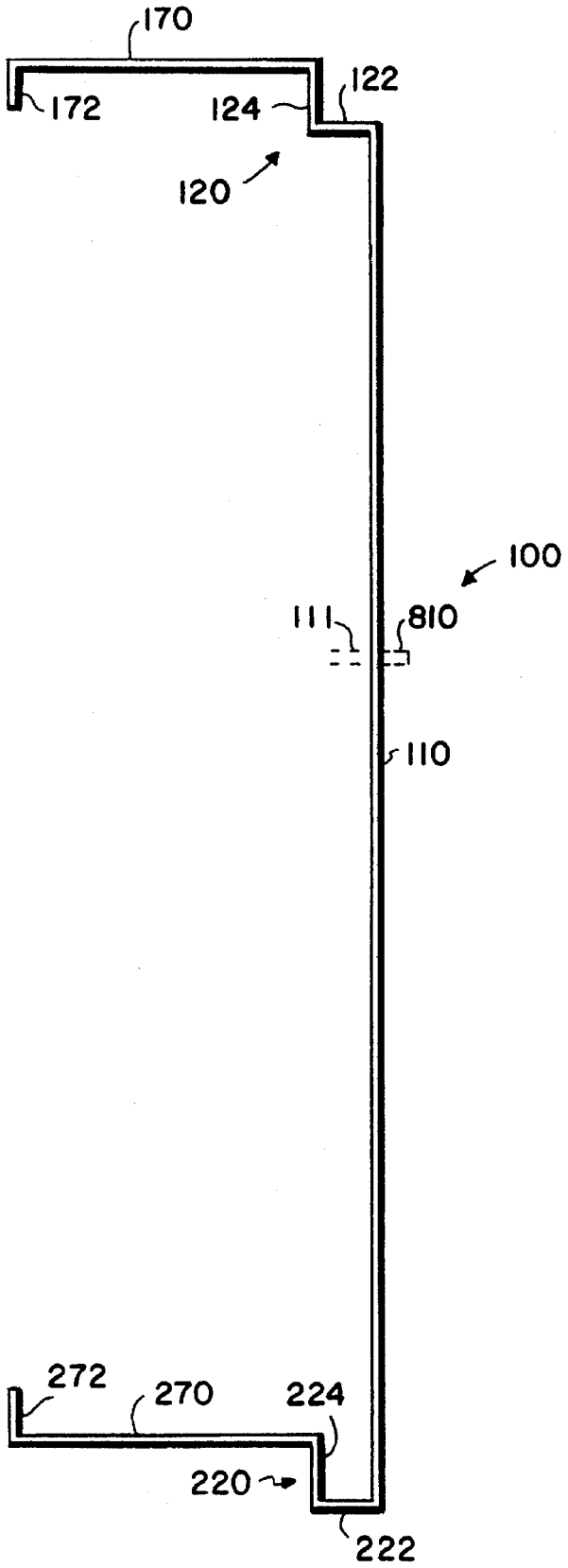
FIG. 3 is an end view of the wall clip on an enlarged scale.
Figure 4:
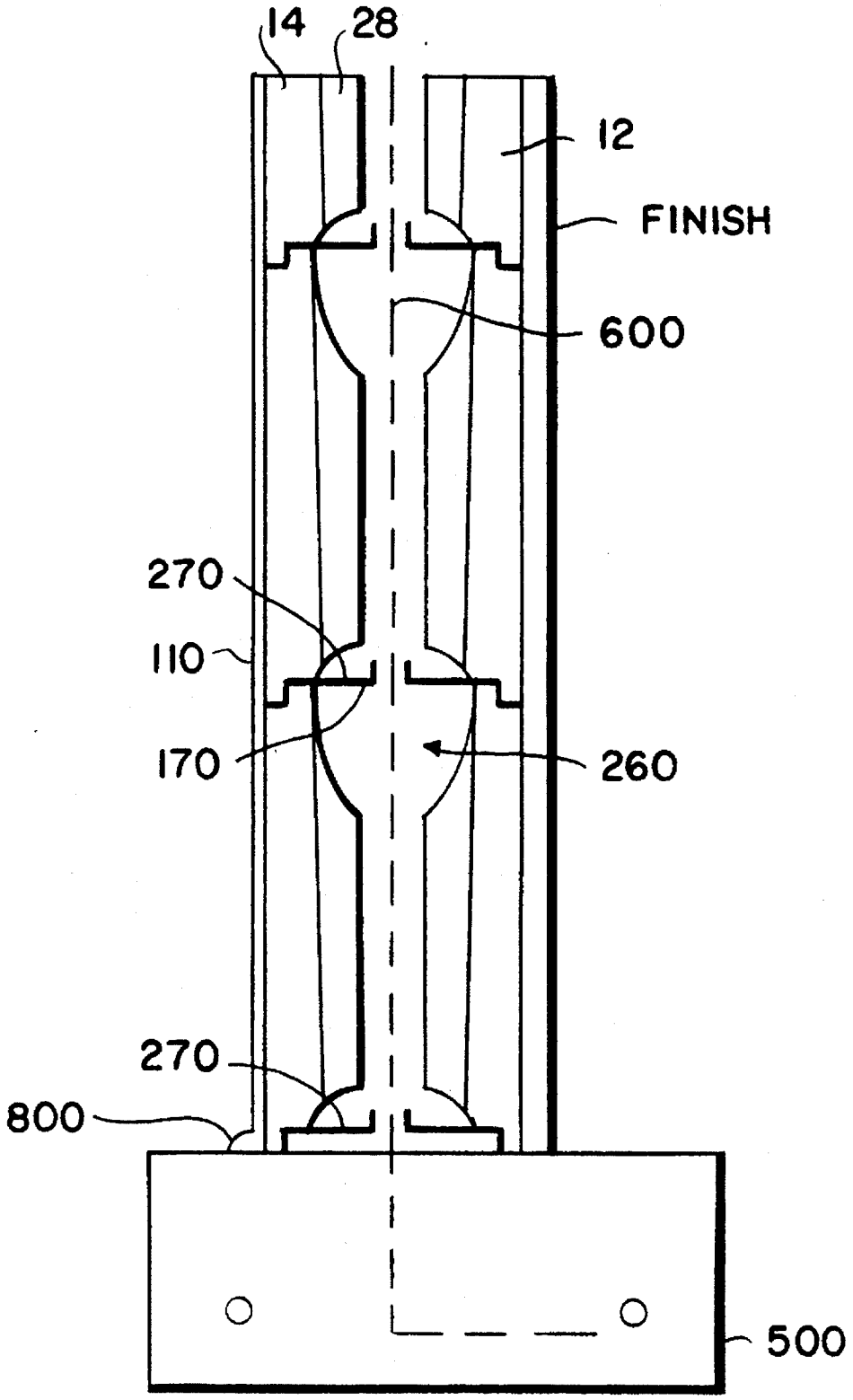
FIG. 4 is a diagrammatic end view showing the wall clips in use with a plurality of concrete forms.

As shown in FIG. 3 the wall clip 100 comprises a metal plate or stud 110 having a length for extension along the vertical extent of the respective sidewalls 12, 14. At the top of the stud 110 is a first linkage structure 120 for extending the upper anchor 170 across the tongue 34 located at the upper edge 16 of each sidewalls 12, 14. The structure 120 is designed to conform to the top edge 16 of a form 10 and comprises a first horizontal flange 122 normal to the upper end of stud 110. A vertical wall 124 upwardly extends from plate 122. Horizontally extending from the top of the vertical wall 122 is a generally horizontal anchor plate 170. A lip 172 depends from the anchor 170 and is generally parallel to the sidewalls 12, 14.

At the bottom of stud 110 is a second linkage structure 220. Structure 220 conforms to the configuration of the lower edge of the sidewalls 12, 14 of the selected form 10. The structure 220 comprises a horizontal plate 222 normal to the lower end of stud 110. A vertical wall 224 upwardly extends from the plate 222. Horizontally extending from wall 224 is a lower anchor 270 with a lip 272 upwardly extending therefrom.

Accordingly, it can be seen that the respective linkage structures 120, 220 have members which conform to the sectional configurations of the respective tongue and grooves. As the clips 100 are made of a pliable metal (18–22 gauge) they are conformed on site to such tongues and groove configurations such as shown in FIGS. 5 and 6. Thus, the wall clip 100 need not be limited to one type of form. Such conformation of the linkage 120, 220 allows the tongue 34 and groove 36 combination of forms 10 to mate with no significant interference being offered by the surrounding linkage structure. An aperture 111 in wall stud also allows for protrusion of a nail 810 therethrough to further maintain the stud in place adjacent the wall.

Alternatively, it is understood that the respective grooves or tongues may be notched such as to extend the anchors 170, 270 from the top and/or bottom of the nailing surface 100 and across the respectively notched tongue and/or groove without interfering with the mating function.

As above stated the pouring of the concrete between the sidewalls 12, 14 of the course of forms 10 produces the above-described piers, vertical walls and horizontal beams. During such pouring the concrete surrounds the vertically displaced anchors 170, 270. Accordingly, the embedded anchors 170, 270 maintain the stud 110 adjacent the sidewalls 12, 14 in the face of the hydraulic load acting thereon. Absent the anchors 170, 270, the load could displace the stud nailing surface 110 from the adjacent sidewalls 12, 14.

The anchors 170, 270 may also be twisted at their free ends. The twisted anchors will produce convoluted surfaces so as to increase the surface area of the anchors 170, 720 which interface with the concrete. In either case the anchors maintain the nailing surface 110 adjacent the form 10 sidewalls 12, 14. Thus, any lateral or longitudinal shifting of the nailing surfaces 110 is precluded during concrete pouring, curing and subsequent nailing therethrough.

A plurality of nailing surfaces is presented by the studs 110 spaced along the longitudinal extent of the chosen sidewalls 12, 14. The finished materials are fastened to the respective sidewalls with the nailing surfaces providing purchase and support for the respective fasteners. The stud 110 support precludes the fasteners from tearing the foam of the sidewalls 12, 14 or being displaced therefrom.

It is to be understood that the drawings are for purposes of illustration and not limitation. Moreover, while certain forms of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. In combination with a concrete form comprising first and second laterally spaced-apart sidewalls having upper and lower edges for presenting a cavity between said sidewalls, a wall clip comprising:

an elongated stud extending between said upper and lower edges of one of said sidewalls, said stud having upper and lower ends;

an upper anchor having a free end, said upper anchor extending from said upper stud end over said upper edge of said one sidewall and into said cavity;

a lower anchor having a free end, said lower anchor extending from said lower stud end over said lower edge of said one sidewall and into said cavity;

said anchors maintaining said stud adjacent said one sidewall.

2. The device as claimed in claim 1 wherein said stud comprises a flat sheet of metal adjacent said one sidewall.

3. The device as claimed in claim 1 further comprising:

first linkage means at said upper end of said stud for connecting said upper end of said stud to said upper anchor, said first linkage means extending a portion of said first anchor across a mating element at said upper edge of the sidewall.

4. The device as claimed in claim 1 further comprising:

second linkage means at said lower end of said stud for connecting said lower end of said stud to said lower anchor, said second linkage means extending a portion of said lower anchor across a mating element at said lower edge of the sidewall.

5. The device as claimed in claim 3 wherein said mating element is a tongue extending along said sidewall upper edge.

6. The device as claimed in claim 4 wherein said mating element is a groove extending along said sidewall lower edge.

7. The device as claimed in claim 3 wherein said first linkage means is conformable to a cross section of said upper edge and said mating element thereon.

8. The device as claimed in claim 4 wherein said second linkage means is conformable to a cross section of said lower edge and said mating element thereon.

9. In combination with a concrete form comprising first and second laterally spaced-apart sidewalls each having upper and lower edges with male and female mating elements longitudinally extending along said upper and lower edges, respectively a wall clip comprising:

at least one nailing surface for placement adjacent an exterior surface of at Least one of said sidewalls, said nailing surface having upper and lower ends;

an upper anchor having first and second ends;

first means at said upper end of said nailing surface for linking said first end of said upper anchor to said upper end of said nailing surface, said linking means conformable to the configuration of a cross section of said mating element and said upper edge of said one sidewall of said form;

a lower anchor having first and second ends;

second means at said lower end of Said nailing surface for linking said lower end of said nailing surface to said first end of said lower anchor, said linking means conformable to the configuration of a cross section of said mating element and said lower edge of said one sidewall of said form, said first and second linking means extending said second ends of said respective upper and lower anchors into a cavity formed between said sidewalls of the form, said anchors maintaining said nailing surface in place adjacent said exterior surface of said one sidewall.

10. In combination with a concrete form comprising first and second laterally spaced-apart sidewalls with a cavity therebetween and having upper and lower edges with male and female mating elements longitudinally extending along said upper and lower edges, respectively a wall clip comprising:

at least one nailing surface for placement adjacent one of said sidewalls, said nailing surface having upper and lower ends;

means at said upper end of said nailing surface for releasably attaching said upper end of said nailing surface to said male mating element along said upper edge of said one sidewall and including an anchor for extension into said cavity;

means at said lower end of said nailing surface for releasably attaching said lower end of said nailing surface to said female mating element along said lower edge of said one sidewall and including an anchor for extension into said cavity, whereby said attaching means anchor said nailing surface in place adjacent said one sidewall.

* * * * *

UNITED STATES PATENT AND TRADEMARK OFFICE

CERTIFICATE OF CORRECTION

PATENT NO. : 5,454,199

DATED : October 3, 1995

INVENTOR(S) : KENNETH M. BLOM, JAY D. WILLIAMSON and JAMIESON VAUGHAN

It is certified that error appears in the above-indentified patent and that said Letters Patent is hereby corrected as shown below:

Column 1, line 33, after "desired," insert --e.g. when forms are utilized below grade. Also, such forms--.

Column 4, line 47, delete "first" and substitute --upper--.

Column 5, line 7, delete "Least" and substitute --least--.

Column 5, line 17, delete "Said" and substitute --said--.

Signed and Sealed this

Twelfth Day of March, 1996

Bruce Lehman

*Attest:*

BRUCE LEHMAN

*Attesting Officer*

*Commissioner of Patents and Trademarks*